US007609284B2

(12) United States Patent
Turner et al.

(10) Patent No.: US 7,609,284 B2
(45) Date of Patent: Oct. 27, 2009

(54) METHOD FOR QUALITY IMPROVEMENT OF PRINTING WITH A THERMOTRANSFER PRINT HEAD AND ARRANGEMENT FOR IMPLEMENTATION OF THE METHOD

(75) Inventors: Olaf Turner, Berlin (DE); Ratmund Nisius, Berlin (DE); Frank Reisinger, Oranienburg (DE); Sabine Roth, Berlin (DE)

(73) Assignee: Francotyp-Postalia GmbH (DE)

( * ) Notice: Subject to any disclaimer, the term of this patent is extended or adjusted under 35 U.S.C. 154(b) by 431 days.

(21) Appl. No.: 11/677,164

(22) Filed: Feb. 21, 2007

(65) Prior Publication Data

US 2007/0206043 A1 Sep. 6, 2007

(30) Foreign Application Priority Data

Mar. 1, 2006 (DE) ..... 10 2006 009 334

(51) Int. Cl.
*B41J 2/35* (2006.01)
*B41J 2/38* (2006.01)

(52) U.S. Cl. ..... 347/186

(58) Field of Classification Search ..... 347/185, 347/186, 188–196; 400/120.08, 120.09, 400/120.14, 120.15

See application file for complete search history.

(56) References Cited

U.S. PATENT DOCUMENTS 4,746,234 A 5/1988 Harry
4,859,093 A * 8/1989 Plotnick ..... 400/120.08
5,006,866 A 4/1991 Someya
5,132,703 A 7/1992 Nakayama
5,453,776 A 9/1995 Günther
5,546,112 A 8/1996 Hunter et al.
5,625,399 A 4/1997 Wiklof et al.
5,706,045 A * 1/1998 Inoue ..... 347/211

(Continued)

FOREIGN PATENT DOCUMENTS

DE 38 33 746 A1 4/1990

(Continued)

OTHER PUBLICATIONS

Patent Abstracts of Japan Publication No. 61239966, For Japanese Application 50081275.

*Primary Examiner*—Huan H Tran
(74) *Attorney, Agent, or Firm*—Schiff Hardin LLP

(57) ABSTRACT

In a method and apparatus for improving the printing with a thermotransfer print head, an energy value is calculated before the printing process according to different types to be implemented when a dot is to be printed. Energy values also are calculated for the heating elements at the ends of the row of heating elements of the high-resolution thermotransfer print head, so as to activate these heating elements even though in heating phases no dot to be printed at the border external to the barcode image. Additionally, those heating elements that do not lie in the two border regions of the heating element row are also activated for a limited time duration, the aforementioned time duration directly preceding the printing of a barcode image. A microprocessor calculates the energy values and is connected with a pixel energy memory for non-volatile buffering of the data that are transferred into a print data controller and are converted into a print pulse duration.

18 Claims, 7 Drawing Sheets

U.S. PATENT DOCUMENTS

| | | | | |
|---|---|---|---|---|
| 5,765,953 | A | 6/1998 | Takahashi | |
| 5,953,426 | A | 9/1999 | Windel et al. | |
| 6,041,704 | A | 3/2000 | Pauschinger | |
| 6,670,976 | B2 * | 12/2003 | Watanabe | 347/186 |
| 7,256,804 | B2 * | 8/2007 | Reisinger | 347/186 |
| 2003/0146967 | A1 | 8/2003 | Miller | |

FOREIGN PATENT DOCUMENTS

| | | |
|---|---|---|
| EP | 1 284 196 A2 | 2/2003 |

* cited by examiner

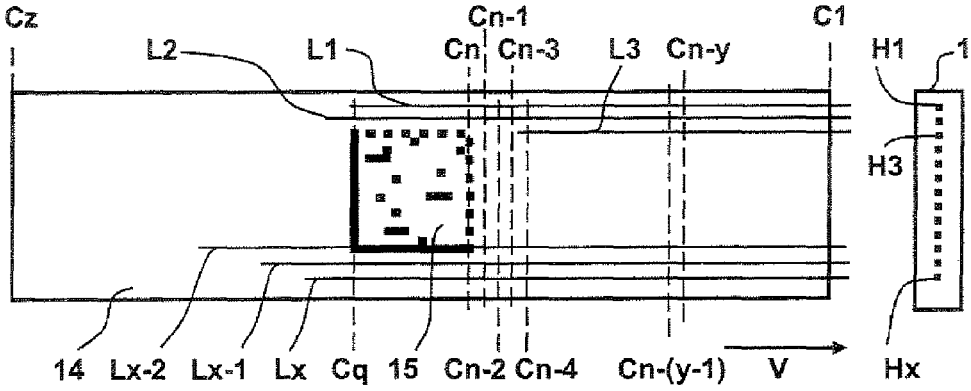
Fig. 1
Fig. 2
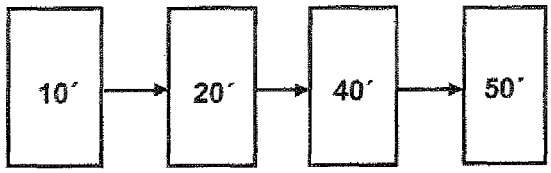
Fig. 3
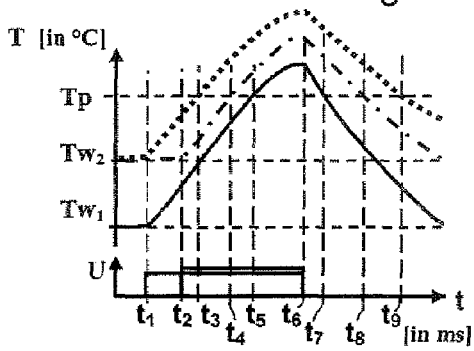
Fig. 4
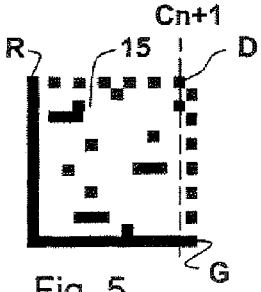
Fig. 5
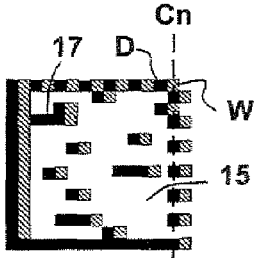
Fig. 6
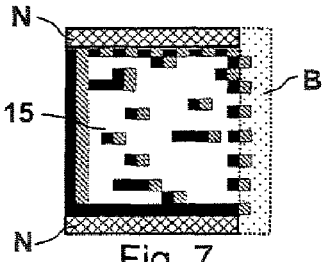
Fig. 7
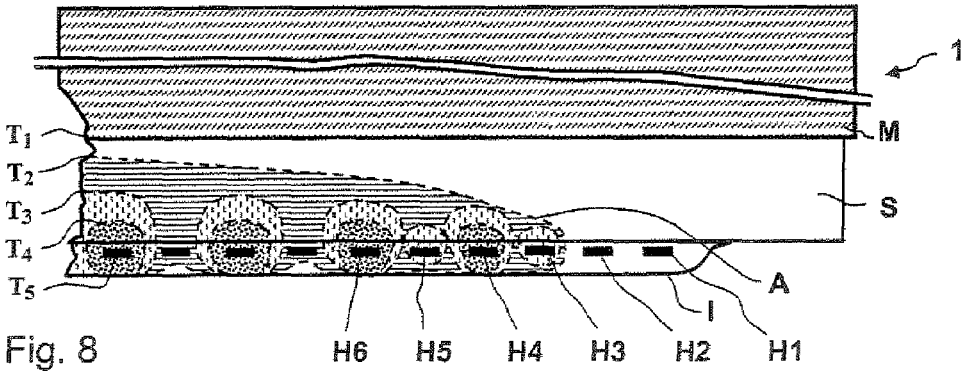
Fig. 8

Barcode module (printed)

Boundary region N2 (without heating of heating elements)

Boundary region N1 (heating of heating elements)

Leading region B (preheating of heating elements)

Region for the data content of the barcode

Barcode module (printed)

Boundary region (20% heating)

Boundary region (10% heating)

METHOD FOR QUALITY IMPROVEMENT OF PRINTING WITH A THERMOTRANSFER PRINT HEAD AND ARRANGEMENT FOR IMPLEMENTATION OF THE METHOD

BACKGROUND OF THE INVENTION

1. Field of the Invention

The invention concerns a method for improving the quality of printing with a thermotransfer print head and an arrangement for implementation of the method. The invention is used in printing devices with relative movement between the thermotransfer print head and the print good, in particular in franking machines and in accounting or mail processing apparatuses that print in a similar manner. The invention is more specifically for increasing quality in the printing of data matrix barcodes with a high throughput of mail pieces, particularly for improving the machine-readability of such data matrix barcodes.

2. Description of the Prior Art

A franking machine with a thermotransfer print device that more easily allows changing of the print image information is described in U.S. Pat. No. 4,746,234. Semi-permanent and variable print image information are electronically stored as print data in a memory and are read out in the thermotransfer print device for printout thereof. As is generally known, the print image (franking stamp image) includes identification and postal information, including the postal fee data for conveyance of the mail piece, for example a postage value image, a postal image with the postal delivery location and date, as well as an advertising stamp image.

The entire print image is printed by a single thermotransfer print head in print image columns controlled by a microprocessor-controlled. The printing of the print columns ensues orthogonally relative to the transport direction on a moving mail piece. A typical machine of this type can achieve a maximum throughput of franking items of 2200 letters/hour at a print resolution of 203 dpi.

The franking machine T1000, commercially available from Francotyp-Postalia GmbH, has only one microprocessor for controlling a thermotransfer print head with 240 heating elements in printing in columns. All heating elements lie in a row which is 30 mm long and is arranged orthogonal to the transport direction. For printing, thermotransfer printers use an at least equally wide thermotransfer ink band which is arranged between a surface to be printed (for example of a mail item) and the series of heating elements. At the resistor of the activated heating element the energy of an electrical pulse is transduced into heat energy which transfers to the thermotransfer ink ribbon. Printing requires melting a small area of an ink layer from the thermotransfer ink ribbon and application of the melted ink layer onto the print good surface. The printing ensues only if the heating element charged with the pulse was brought to printing temperature, i.e. to a temperature higher than the preheating temperature Given movement of the thermotransfer ink ribbon together with the mail item relative to the heating elements and given a running heat energy feed, a line (dash) is printed in one row parallel to the movement (transport) direction. A line is printed in a print column orthogonal to the movement or transport direction when all heating elements in the row of heating elements are simultaneously charged with electrical pulses for a predetermined, limited time duration (pulse duration). The pulse duration can be sub-divided into phases. Within the predetermined, limited time duration (pulse duration), a last phase (print phase) exists in which the dots of a print column are printed. Further phases of the activation of the heating elements precede the last phase in order to heat the printing element to the printing temperature. Print image columns also can be associated with these phases due to the transport of the mail piece. A longer individual pulse for activation of a heating element can be divided into a number of pulses whose pulse durations are identical and correspond to a specific heating phase. Print image columns of the moving mail item are thus likewise associated with these heating phases, as the print columns are associated with the print phases.

The binary pixel data for activation of the heating elements of all print columns are non-permanently stored in a pixel memory. Given a low print resolution, the spacing of adjacent print columns is large and the binary pixel data of the print phase reflect the print image. A number of pulses are conventionally required in order to generate sufficient heat energy for melting an area of the ink layer under the heating element, the ink layer area then being printed as a dot on the surface of the mail piece (DE 38 33 746 A1).

In principle, to achieve a high print resolution printing could ensue in each phase when the activation of the heating elements for heating thereof ensues only in a timely manner in preceding phases. This requires that the energy of an electrical pulse is likewise transduced into heat energy at the resistor of the adjacent heating element in the row (heat conduction problem). The heat energy is reduced by cooling when the pulse is omitted. Due to the adjacent energy application, spread of heat energy by heat conduction can be taken into account by the activation of specific heating elements for heating thereof being interrupted in one phase, but nevertheless sufficient heat energy is present to effect melting of the ink layer area under the heating element. A microprocessor is therefore also programmed to control the energy distribution dependent on the pattern to be printed, in addition to the preparation and output of binary pixel data for generation or non-generation of an electrical pulse. The original representation of the print image by binary pixel data is thus correspondingly altered in the pixel memory so that a cleaner print image is created. This requires either a comprehensive preliminary calculation (as is, among other things, known from EP 53 526 B1 (=DE 41 33 207 A1) Method for Controlling the Feed of a Thermoprinting Heating Element) or a history-based control (history control). In the case of history control, the supplied energy for preheating a respective heating element of the thermotransfer print head is adjusted dependent on whether printing processes have been initiated frequently or rarely in the recent past involving activation of that heating element.

From JP 61-239966 it is known to separately control the temperature of the individual heating elements by a pulse width modulation dependent on adjacent data, and to temporarily raise the temperature to the value necessary for printing. Nevertheless, the appertaining heating element (and thus the entire thermotransfer print head) remains relatively cool in spite of the preheating. This is desirable so that the temperature curve falls off relatively steeply, so that the time between the successive raster points in time can be short. This technique shortens the time necessary for a plotting of dots on a print medium and thus increases the printing speed.

A microprocessor with a higher calculation speed could be used to achieve a higher print resolution. The output of binary pixel data to the thermotransfer print head would then ensue more often per time unit in which a mail piece or similar print item is further moved an identical amount along the transport path. The memory space requirement in the pixel memory for the pixel data, however, increases for each additionally-inserted virtual column or heating phase. A "virtual column"

means the presence of a further column in the print image that is not visible upon printing since no dot is printed in the heating phase.

Since the market introduction of the franking machine T1000 (the T1000 franking machine being the first to be equipped to change the aforementioned advertisement stamp image electronically at the press of a button in addition to changing the date and the postal fees), the demands on the microprocessor controller of the T1000 franking machine have become steadily greater. More data are processed as more variable data are required in the print image. Moreover, it is also applicable to generate other print images that differ significantly from a franking stamp image in terms of design and content in order, for example, to print out business cards, fees, and court cost stamp images. The requirements for the print resolution in dpi (dots per inch) steadily increase. Upon printing of a dot, the aforementioned heat conduction problem between the adjacent heating elements due to the adjacent pixels in the print image to be printed occurs more strongly the closer that the pixels are to each other. The aforementioned problem which is connected with the thermotransfer printing method increases at high print resolution.

Modern franking machines should enable the printing of a security imprint, i.e. an imprint of a special marking in addition to the aforementioned information. For example, a message authentication code or a signature is generated from the aforementioned information and then a character string or a barcode is formed as a marking. When a security imprint is printed with such a marking, that enables a review of the authenticity of the security imprint, for example at the post office or at the private carrier (U.S. Pat. Nos. 5,953,426 and 6,041,704).

The development of the postal requirements for a security imprint in some countries has had the consequence that the amount of the variable print image data that must be changed between two imprints of different franking stamp images is very high. For example, for Canada a data matrix code of 48×48 image elements should be generated and printed for every single franking imprint.

For more rational postal distribution and to increase security against counterfeiting, a new standard called FRANKIT® was introduced in Germany by Deutsche Post AG in 2004. Even at low print speed, the print quality of known franking machines with thermotransfer printing is not good enough for the machine readability of a 2-D barcode, as required by FRANKIT. In addition to the printing speed, however, the print resolution also had be increased to 300 dpi for printing of such a two-dimensional barcode A high throughput of mail pieces means a lower quality in the printing, in particular of data matrix barcodes, such that their machine readability is not always guaranteed. The microprocessor of a franking machine suitable for this has more data to process in a shorter time. The heat energy for printing the image elements of the franking machine should be calculated in a microprocessor-controlled manner taking into account the immediately preceding two print columns printed in the past. Such a history control is known but would now have to be expanded for the purpose of taking into account much more information in order to improve the readability of data matrix barcodes.

The printed data matrix barcode, at each of the left edge and lower edge, has a continuous line (called a 100% line) and at the right edge and upper edge has a discontinuous line composed of barcode image elements (called a 50% line because every other barcode image element is missing). Instead of being printed as a point, the barcode image elements (modules) are conventionally printed in quadratic form (FIG. 1).

The high-resolution images printed with previous methods, in particular barcode images, are printed out differently at the edges than in the center and thus are not always machine-readable.

SUMMARY OF THE INVENTION

An object of the invention is to provide a method for improving the quality of printing with a thermotransfer print head and an associated arrangement that improves the machine-readability of barcodes.

The above object is achieved in accordance with the present invention by a method and apparatus for improving the printing with a thermotransfer print head, wherein an energy value is calculated before the printing process according to different types to be implemented when a dot is to be printed. Energy values also are calculated for the heating elements at the ends of the row of heating elements of the high-resolution thermotransfer print head, so as to activate these heating elements even though in heating phases no dot to be printed at the border external to the barcode image. Additionally, those heating elements that do not lie in the two border regions of the heating element row are also activated for a limited time duration, the aforementioned time duration directly preceding the printing of a barcode image. A microprocessor calculates the energy values and is connected with a pixel energy memory for non-volatile buffering of the data that are transferred into a print data controller and are converted into a print pulse duration.

Upon the printing of a data matrix barcode, the print head heats significantly such that the generated barcode image elements (modules) are printed distinctly wider (broader) in the course of the printing (primarily in the printing direction) than at the beginning. The barcode image elements of the 50% line at the upper edge form a chessboard-like pattern, but often become too small or are printed too faintly for the remaining barcode image elements. In conjunction with further unavoidable printing defects, both border effects lead to degradation in the readability of this barcode. The barcode image elements should assume an identical size left and right, top and bottom. For compensation of the border effects, the heating elements and therewith also the surrounding heat capacitors in the region before the barcode (known as the quiet zone) are therefore pre-heated. For this purpose a specific number of heat phases are provided that can be associated with respective print image columns given a moving print item in order to heat the heating elements to a preheating temperature so that the thermotransfer process is not just yet initiated. This leads to a desired, more advantageous temperature distribution in the print head, and as a result to a comparison moderation of the printing, in particular to an enlargement of the barcode image elements at the beginning of the printing of the barcode image. The size of the barcode image elements at the end of the barcode image is only slightly larger in comparison to the beginning.

In a border region between the 50% line and the edge of the franking strip, a small number of heating elements is activated so that these are sufficiently warm and the border effect is compensated, but the thermotransfer process is not yet initiated. The environment of the 50% line is thereby heated such that barcode image elements at the edge are reproduced just as well as in the middle of the barcode.

The number of the preheating columns and the border rows and/or the respective heat energies are adapted to the temperature of the print head.

Although the invention is explained herein using the example of a franking machine, it is not limited solely to this type of printer.

DESCRIPTION OF THE DRAWINGS

FIG. 1 shows a simplified representation of a franking strip with a barcode.

FIG. 2 is a plan view of a simplified thermotransfer print head.

FIG. 3 is a simplified flow chart for processing image data required for printing according to the prior art.

FIG. 4 shows a temperature curve and pulse/time diagram given printing of a dot.

FIG. 5 shows a simplified representation of the barcode data.

FIG. 6 shows a barcode image for explanation of the barcode data preparation using history control.

FIG. 7 shows a barcode image with external regions for explanation of a data preparation that is different for these regions, the external regions serving for pre-heating of heating elements (variant 1).

FIG. 8 is a section through a thermotransfer print head along a row of resistor heating elements.

DESCRIPTION OF THE PREFERRED EMBODIMENTS

Figure 9:
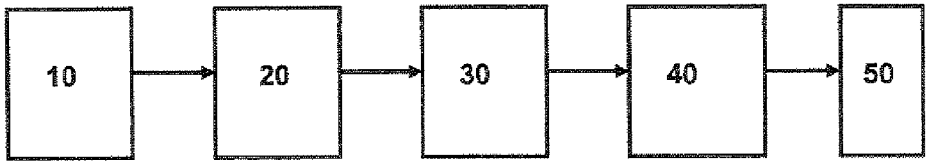
FIG. 9 is a flow chart for processing image data required for printing in accordance with the invention.

FIG. 1 shows a simplified representation of a franking strip 14 with a barcode 15. The franking label or a mail piece (for example a letter envelope) with an equally large field for printing of a franking stamp image and further information on its surface, is moved along with a constant speed v in the transport direction (arrow) below a thermotransfer print head during the printing. The field has, for example, a width of 30 mm and a length of 160 mm. For clarity, in the representation the thermotransfer print head and a thermotransfer ink ribbon that is arranged in a known manner between the thermotransfer print head and the surface of the field to be printed in a printing direction, have been omitted. At the beginning of the printing, dots are arbitrarily printed in a first print column C1 on the surface of the franking label or letter envelope at a first interval from its right border. For simplicity the franking stamp image printed on the surface from C1 up to the print column Cn−4 was not shown as well. If a first heating element of the thermotransfer print head were constantly be activated and charged with a current pulse, a number of printed dots would then lie on a line L1. Further lines L2, L3 . . . through Lx lie parallel to the first line L1 and orthogonal to the print columns. The lines are represented as a thin dash and the print columns are represented as perpendicular dashed lines. The first dots of a first barcode in a predetermined print column Cn are printed as of a second larger interval from the right border of the franking strip or letter envelope or other print good. The barcode image 15 printed on the surface up to a third interval from the right border of the franking label, with the last dots lying in a print column Cq, was shown simplified. These last dots of the barcode image abut one another in a row. The dots of the barcode image likewise lie on a line Lx-2 and form a base line. However, no dots are printed on the lines L1 and L2 as well as Lx and Lx-1 in the print columns Cn through Cq. The franking label or letter envelope can be further printed with an advertisement cliché, a second barcode, or a logo from the print column Cq+1 through Cz, i.e. up to near the left border.

A plan view of the heating element side of a simplified thermotransfer print head 1 is schematically shown in FIG. 2. Its heating elements H1 through Hx lie in a row and are closely adjacent. For simplicity it is assumed that, upon activation, a heating element H1 . . . Hx can print a dot on an associated line L1 . . . Lx when the franking label is moved across with a constant speed V under the heating element row.

A simplified flow plan of the processing of image data required for printing according to the prior art is shown in FIG. 3. In a first determination step 10', the image information required according to the postal specifications are stored as data in a working memory (RAM) of the franking machine. In a second control step 20', the data are processed by the microprocessor in order to differently activate heating elements depending on the prior history. In addition to such a history control, for activation of a heating element the current activation state of the immediately adjacent heating elements and their prior history are also taken into account. Moreover, environment temperature and a temperature measured in the print head as well as further machine parameters are taken into account in the activation of a heating element. In a formatting step 40' the print data are brought into a format suitable for the print head by a known controller and are output via a corresponding interface. In a last feed step 50', the print data are converted by internal electronic of the thermotransfer print head into print pulses of predetermined voltage level and with a separate adjustable duration for the heating elements.

FIG. 4 shows a temperature curve and a pulse/time diagram given the printing of a dot. An activation pulse for a heating element begins, for example, at the point in time $t_1$ and ends at the point in time $t_6$. A temperature curve according to the continuous line results when a first temperature $Tw_1$ is measured in the immediate vicinity of the heating element and is lower than the temperature Tp required for printing. The printing then begins at the point in time $t_5$ and ends at the point in time $t_7$, i.e. when the temperature Tp required for printing is under-run. The dot appears to us to be printed too faintly. A temperature curve according to the dotted line results when a second temperature $Tw_2$ in the immediate vicinity of the heating element is higher than a first temperature $Tw_1$ and is lower than the temperature Tp required for printing. The printing then begins at the point in time $t_3$ and ends at the point in time $t_9$. The dot appears to us to be printed too heavily. Starting from the second temperature $Tw_2$ in a second step 20', this can be partially compensated by beginning an activation pulse for printing first at a point in time $t_2$ and ending the pulse at the point in time $t_6$. The dot appears to the viewer to be normal, possibly as printed somewhat more heavily since the printing begins at the point in time $t_4$ (i.e. earlier) and only ends at the point in time $t_8$ (temperature curve of the dash-dot line). The cooling process of the heating element begins after the end of the activation pulse but runs less intensively and slower. This too-faint printing can not be compensated in the second step 20' of the method according to the prior art.

FIG. 5 shows a simplified representation of the barcode data via conversion into a desired barcode image 15. A row R and a base line G are formed from square image elements (pixels) at the left border and lower border. For simplification it is assumed that a heating element H3 prints a dot D of a size (0.6×0.6 mm) on the line L3 in the print column Cn+1, possibly offset by one image element (pixel) since, given corresponding size of the heating elements and thus also of the enlarged dimensions of the dots D, the prior history and the aforementioned mis-positioning effect do not interfere. The barcode image then reflects the stored barcode data. In practice, naturally, a number of dots are necessary in order to generate a quadratic barcode image element (module). For example, 6×6 dots in Canada or 7×7 dots in Germany are required per module. A module for FRANKIT in Germany is, for example, 0.583×0.583 large.

A barcode preparation using a simple history control is explained using the simplified representation as a barcode image in FIG. 6. A heating element H3 (not shown) is fed with current in a heating phase W that can be associated with a print column Cn given a moving franking strip. The print column Cn lies chronologically immediately before the print column Cn+1. The heating element H3 is thereby heated to a preheating temperature. The printing of a dot D ensues first in a print column Cn+1, i.e. only when the heating element charged with a print pulse has been brought to printing temperature, i.e. temperature higher than the preheating temperature. At least one heating phase W chronologically anticipates the printing in the aforementioned print column, but during the heating phase dots can also be printed in a different print column. When that is provided on the same line, the heating to a preheating temperature can be omitted, as can be seen by the printed dot 17.

Regions of the barcode image with externally different data preparation are shown in FIG. 7. At most heating phases but no print phases exist in a dotted region B, that is also known as the quiet zone and is placed right before the barcode, meaning that sufficient energy for printing is supplied to none of the heating elements. In lateral adjoining regions N of the barcode image 15, no energy is supplied to any heating element. The barcode data preparation therefore predominantly ensues in the region of the barcode image 15. This leads to a typical heat distribution in the print head with cooler border regions.

The heat distribution and the design of the thermotransfer print head 1 are now explained using FIG. 8, which shows a section through a thermotransfer print head along the row of resistor heating elements. The thermotransfer print head 1 has a 0.65 mm-thick substrate S (that can be made from an electrically-insulating ceramic plate) that is glued into an approximately 5 mm-thick metal plate. For example, a first temperature $T_1$ of approximately 50° C. predominates at the boundary layer ceramic/metal. A second temperature $T_2$ of approximately 70° C. is achieved at a second boundary layer E within the ceramic body. The temperature increases nonlinearly within the region shown in lines) and reaches a third temperature $T_3$ of approximately 80° C. at a third boundary layer. The temperature further increases within a region (shown dashed) around the heating elements H1, H2, . . . H6, . . . until a fourth boundary region with a fourth temperature $T_4$ of approximately 100° C. is reached. This fourth boundary layer extends up to the surface of an approximately 0.2 mm-thick insulation layer I and 2 μm-thick protective layer (not shown) and comes in contact with a thermotransfer ink band (not shown). At approximately 65° C., the ink layer on the thermotransfer ink ribbon melts. An even higher fifth temperature $T_5>T_4$ is even achieved in the heating elements. For printing at a heating element with an electrical resistance of 2 KOhm or 1.6 KOhm, a power of 0.285 W or 0.354 W per dot is transduced into heat by a thermotransfer print head of the type KSL360AAF-PS from the company Kyocera. Each heating element has a size of 0.0683×0.110 mm and is closely adjacent to the respective next heating element so that 12 dots per mm can be printed in a row. The metal plate M is composed of aluminum and is much thicker than the substrate S. It therefore has a good heat conductivity and serves as a heat sink. The thermotransfer print head 1 is attached to the chassis (not shown) of the printing device or franking machine by the metal plate M. The substrate temperature can be measured in a known manner by a thermistor (not shown). The equipotential line A shows a temperature decrease from the center to the edge of the thermotransfer print head 1 that cannot be detected by a thermistor that is glued (in a manner not shown) onto the substrate S at the edge. The insulation layer I can have two glass layers (not shown). The inner glass layer should electrically insulate the heating elements very well and protect against oxygen. The outer glass layer has the thickness of 2 μm and should exhibit a high abrasion (wear) resistance.

An improved flow chart of the processing of image data required for printing is shown in FIG. 9. In the first determination step 10 the image information required according to the postal specifications are stored as data in a working memory (RAM) of the franking machine. The data represent not only each inked print point (dot) that should be printed, but also the necessary energy quantity. The latter is represented as a binary code, for example with 4 bits per pixel as a quadruple, and controls the necessary pulse duration of the activation of a heating element for printing of a dot. This processing of the energy value calculation according to a first type is time-consuming and can therefore not ensue during the printing. A microprocessor is programmed by software for energy value calculation and coding as well as for preparation of pixel energy data. The results of the energy value calculation and coding are buffered in the working memory (RAM) of the franking machine, which is subsequently designated as a pixel energy memory. This enables respective different energy values to be associated with the dots for printing different image segments of the franking stamp image. A suitable method for activation of a thermotransfer print head is disclosed in German patent application 10 2004 063 756.3 (not previously published).

Good readability of the generated imprints can be achieved only when the energy quantity supplied to each heating element is also matched with other parameters, in particular ink ribbon parameters. A print parameter system is therefore read out from a memory that is attached to the ink ribbon cassette in order to calculate the energy values with this set of parameters. A suitable method for activation of a thermotransfer print head is described in German patent application 10 2004 060 156.9 (not previously published).

In a second control step 20, the data are processed by the microprocessor in a known manner in order to activate the heating elements differently dependent on what prior history exists and according to the different spatial heating due to adjacent heating elements. For this purpose energy values of the second type are set for at least that storage space in the pixel energy memory that directly precedes the position of a dot to be printed in the barcode image, although no dot is to be printed at this position according to the barcode image. A heating pulse duration that is smaller than the print pulse duration that would lead to the printing of a dot then results from these energy values of the second calculation type. In the simplest case, the heating pulse duration is set to a predetermined fixed value which was empirically determined. In the normal case, however, the heating pulse duration is variably set to a value that can be selected from a group of predetermined, fixed values and is calculated by the microprocessor. Such a method does not work, however, for heating elements that should print no dots. The start of the barcode as well as the right and left borders of the barcode (as seen in the printing direction) appear to be printed too faintly using conventional methods. The area coverage thus is poor and the print growth is lower than for the image elements/pixels of the barcode that do not lie at the edge or start of the barcode image, which is printed from right to left. The known algorithms are insufficiently suitable for amplification of the image elements/pixels of the barcode situated at the outer edge or beginning. The heat resistance in the print head, which is three-dimensionally distributed, was found to be a basic cause of this problem. The substrate S of the thermotransfer print head cannot be precisely sufficiently heated using a simple history control mechanism that only evaluates a pixel to be printed or print pixel environment information. As a result the high-resolution barcode images printed with previous methods appear to be printed differently at the aforesaid edges than in the inside and thus may be poorly machine-readable.

To improve the machine readability, in a third improvement step 30 the data are processed by a microprocessor wherein those heating elements are activated which lie in both boundary regions of the heating element row being printed, but where no dots should be printed during the printing of a barcode. Additionally those heating elements that do not lie in the two boundary regions of the heating element row are also activated for a limited time duration, the aforementioned time duration immediately preceding the printing of the barcode image. Before the printing of the start of the barcode image and in addition to the right and left edges of the barcode image (viewed in the printing direction), during the printing a number of heating elements in sufficient proximity to those heating elements that print a barcode image are heated with an energy that is determined by variation of the heating pulse duration, such that no printing ensues, in view of the heat capacitances and heat conductivities. The number of the rows and columns is taken into account such that, given the selected energy that is below threshold (or various energies below threshold), a sufficiently uniform heating of the three-dimensionally distributed heat capacitances ensues before and while the barcode image is printed. For this purpose the barcode image to be printed is supplemented in terms of data in the pixel energy memory such that the pixel energy memory now contains data for energy values in the aforementioned front end and the environment of the barcode image to be printed, these energy values pre-heating the thermotransfer print head in the manner described above but not leading to the printing of dots at these positions.

When, for example, the maximum print pulse duration contains 10 phases, then energy values that are reached in 0 to 3 phases are possibly already sufficient. In the region B in the representation according to FIG. 7, up to 3/10 of the maximum energy value $E_{max}$ is then supplied to each heating element. In the region N in the representation according to FIG. 7, up to 2/10 of the maximum energy value $E_{max}$ can be supplied to each heating element.

As a result of the introduction of a predetermined energy value of the third calculation type, an activation of each heating element ensues at predetermined regions of the heating element row, whereby the energy value is predetermined only for preheating but not for printing. A heating pulse duration which is likewise smaller than the print pulse duration that would lead to the printing of a dot then results from these energy values of the third calculation type. In a specific case, the heating pulse duration can be set to a predetermined fixed value which was empirically determined. Given superimposition of an energy value of the second calculation type (hatched image elements of the region B in the barcode image according to FIG. 7) with an energy value of the third calculation type (dotted region B in the barcode image according to FIG. 7) for the activation of one and the same heating element, the energy value of the second calculation type is set when this exceeds the energy value of the third calculation type.

The different temperature distribution in the thermotransfer print head is merely compensated by such heating pulses of shorter length in the heating phases of the heating elements, such that the machine readability of the barcode is improved. A program routine is explained in detail below using FIG. 12.

In a fourth step 40 the data (quadruple) reflecting the respective pixel energy value are transferred from the multiprocessor to a print data controller. A respective predetermined pixel energy value for each heating element is supplied to the print data controller, which pixel energy value is converted into a corresponding number of binary pixel data with the same binary value. The pixel data are serially transferred to the thermotransfer print head.

In the fifth feed step 50, each binary pixel energy value associated with a heating element is output to the respective driver unit of the thermotransfer print head in an associated phase of temporally successive running phases of a print pulse duration, which thermotransfer print head supplies the energy so selected to the heating element.

Figure 10:
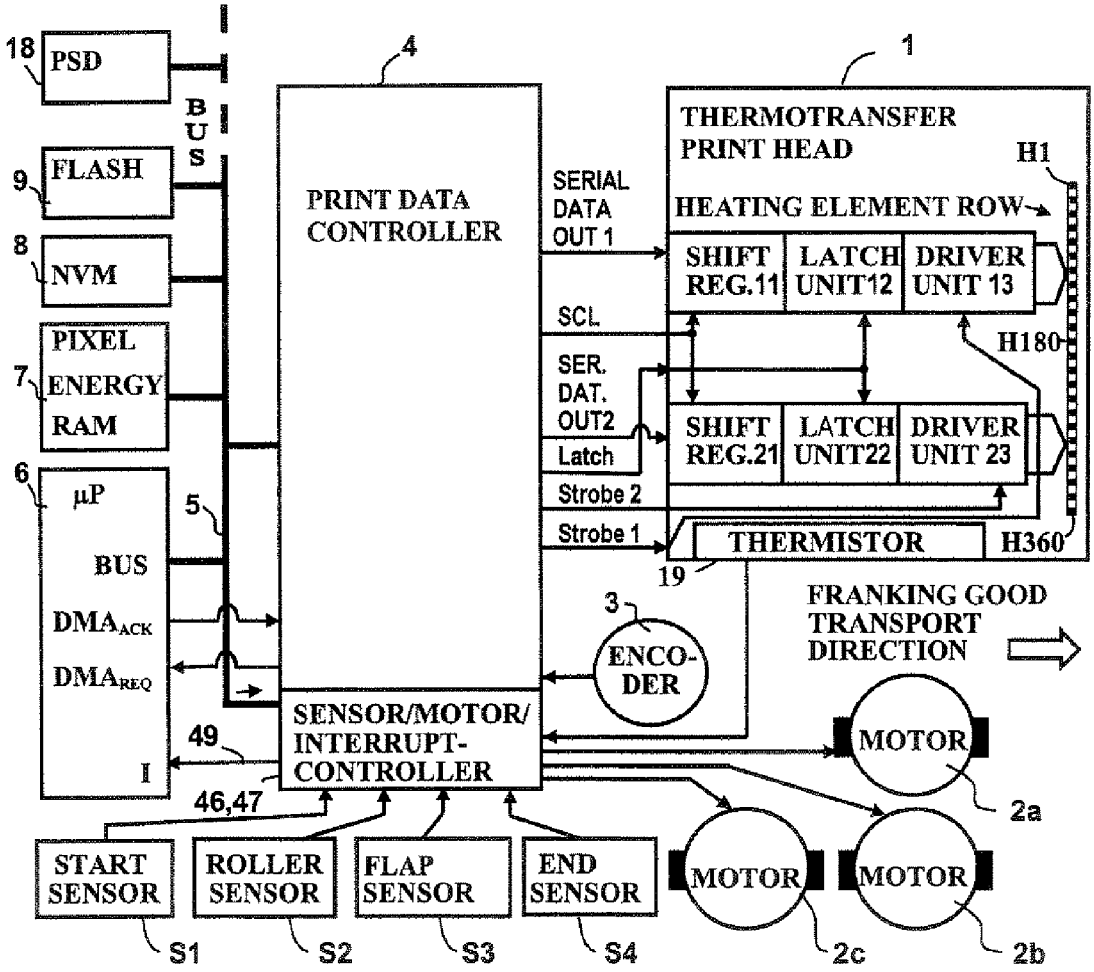
FIG. 10 is block diagram for controlling the printing of a franking machine with a print data controller for a thermotransfer print head.

A block diagram for controlling the printing of a franking machine with a print data controller for a thermotransfer print head is explained using FIG. 10. The franking machine is a special thermotransfer printing device with a microprocessor-aided controller 6, 7, 8, 9 and a print data controller 4 for a thermotransfer print head 1 with high print resolution, whereby the print data controller 4 is connected in terms of address data and control with an encoder 3 and, via a bus 5, with at least one microprocessor 6 and memory modules 7, 8, 9 of the controller. The quadruples are stored in columns in a pixel energy memory (RAM) 7. The quadruples belonging to adjacent pixels of a print column are thereby stored in parallel. A number of 90·16-bit data words is provided for the printing of a column. Given a print resolution of 12 dots per 1 mm (≈300 dpi), up to 175,500·16-bit data words must be stored in the pixel energy memory (RAM) 7 for up to 1950 columns. A postal security device (PSD) as well as further modules (not shown) such as, for example, keyboard, display etc. are connected to the bus 5 corresponding to the postal requirements, Given a direct memory access (DMA) on the input side the print data controller 4 can accept and buffer 16 bits of data present in parallel word-by-word from the bus 5. The print data controller 4 is connected with the thermotransfer print head 1 in terms of control and operates according to German patent application 10 2005 007 220.8-27 (not previously published) Method and Arrangement for Controlling the Printing of a Thermotransfer Printing Apparatus. Each binary pixel energy value supplied to a heating element of the thermotransfer print head is output by the print data controller 4 in an associated phase of temporally successive running phases of a print pulse duration The thermotransfer print head 1 is high-resolution and possesses an internal activation electronic and a number of 360 heating elements that are arranged in a row of approximately 30 mm length. A first portion of 180 heating elements is activated in parallel by a first shift register 11 via a first latch unit 12 and first driver unit 13. A second portion of 180 heating elements is activated in parallel by a second shift register 21 via a second latch unit 22 and second driver unit 23. At least one heating element exists at the border of the heating element row of the thermotransfer print head 1, to which heating element energy is supplied of up to two-tenths of the maximum energy value (as a result of an energy value calculation of a third type that is empirically or calculationally implemented by the microprocessor 8). This heating element is immediately adjacent to a heating element which is used for printing a 50% line at the upper edge of the barcode.

A start sensor S17 a roller sensor S2, a flap sensor S3, an end sensor S4 and a thermistor 19 on the one hand as well as a motor 2*a* for driving a roller (not shown) for winding of the used thermotransfer ink band, a motor 2*b* for driving a counter-pressure roller for print item conveyance during the printing and a motor 2*c* for actuation of the pressure mechanism of the counter-pressure roller (in order to press the print item against the thermotransfer print head 1 are connected to a sensor/motor controller 46. The franking machine achieves a transport speed of approximately 150 mm per second for franking labels or for mail pieces up to 6 mm thick. An interrupt controller 47 is directly connected with the microprocessor 6 via a control line 49 for an interrupt signal I. The print data controller 4, the sensor/motor controller 46 and the interrupt controller 47 can be realized within an application-specific circuit (ASIC) or programmable logic such as, for example, a field programmable gate array (FPGA).

Figure 11:
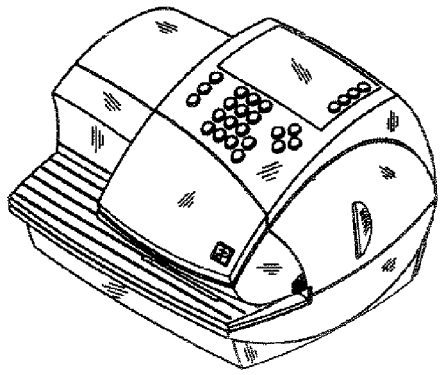
FIG. 11 is a perspective representation of a commercially available franking machine (Optimail 30 of Francotyp-Postalia GmbH).

FIG. 11 shows a perspective view from the front and upper right of a known thermotransfer franking machine of the type Optimail30. Further views of this franking machine can be taken from the Community Utility Model at the Office for Harmonization in the International Market under the number 000199468-0001. Further variants of the franking machine of the type Optimail30 are entered under the numbers 000199468-0002 and 000199468-0003.

The feed and discharge of a mail piece ensues from the left to the right on the feed table at a placement edge on the front side of the franking machine. The franking machine is equipped with a flap at the cartridge bay that is arranged on its right side and on its upper part. Further details can be learned from the German Utility Model DE 20 2004 015 279 U1 [Cartridge Acceptance Device with State Recognition for a Printing Mail Processing Apparatus.

Below a recess in the feed table (not visible), the thermotransfer franking machine of the type Optimail30 has a start sensor and an end sensor with which the microprocessor can reliably detect the start and the end of a mail piece or franking label. Further details can be learned from German Utility Model DE 20 2004 015 279 U1 Arrangement for a Printing Mail Processing Apparatus.

Figure 12:
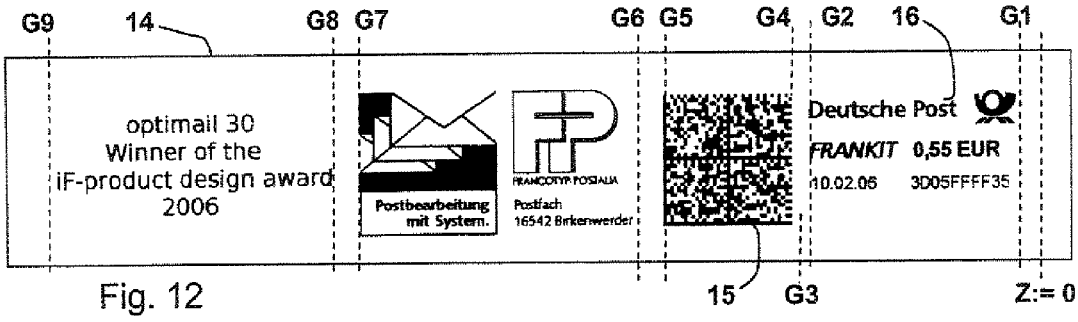
FIG. 12 shows a franking imprint according to the DPAG requirement FRANKIT.

A franking imprint according to the DPAG specification FRANKIT® is shown in FIG. 12, which franking imprint was printed with a thermotransfer franking machine of the type Optimail 30 from right to left on a franking strip 14 while the franking strip 14 is transported from left to right. A franking stamp image 16 on the right side is thus first printed in columns, and subsequently a two-dimensional data matrix barcode 15 with 36×36 image elements is printed. An advertisement cliché and/or additional texts can subsequently be printed in columns. A column counter which is realized by means of the microprocessor begins to count at the counter state Z:=0. A first limit value G1 is reached at the counter state Z:=G1 and initiates the printing of the franking stamp image 16. This ensues until a second limit value G2 is reached at the counter state Z:=G2 at which the printing of the franking stamp image is ended. The franking stamp image 16 in its upper half has the logo Deutsche Post with posthorn followed by the FRANKIT® mark communicated in the next line and a fee amount in euros. The franking stamp image 16 in the lower half has the franking date and the serial number as well as, if applicable, two supplementary lines (not printed). The print image of the data matrix code follows at an interval of 3 mm, i.e. at the counter state Z:=G4. This print image has, for example, a size of 21.336×21.336 mm with an allowed tolerance of ±1 mm according the FRANKIT® version 2.06 from 11 Jan. 2006. The print image ends at a counter state Z:=G5. A print image of an advertisement stereotype then follows at an interval of 3.8 to 5 mm at a counter state Z:=G6. The aforementioned print image here has a size of 45×30 mm. but exhibit a maximum size of 56×30 mm, and ends at a counter state Z:=G7. An additional text in a size up to 50×30 mm can be printed at an interval of 3 mm in a separate print stamp image when a counter state Z:=G8 is exceeded. Alternatively, a print image for additional letter services can also be printed at the position of advertisement stereotype and additional text. The aforementioned print stamp image ends at a counter state Z:=G9.

Figure 13:
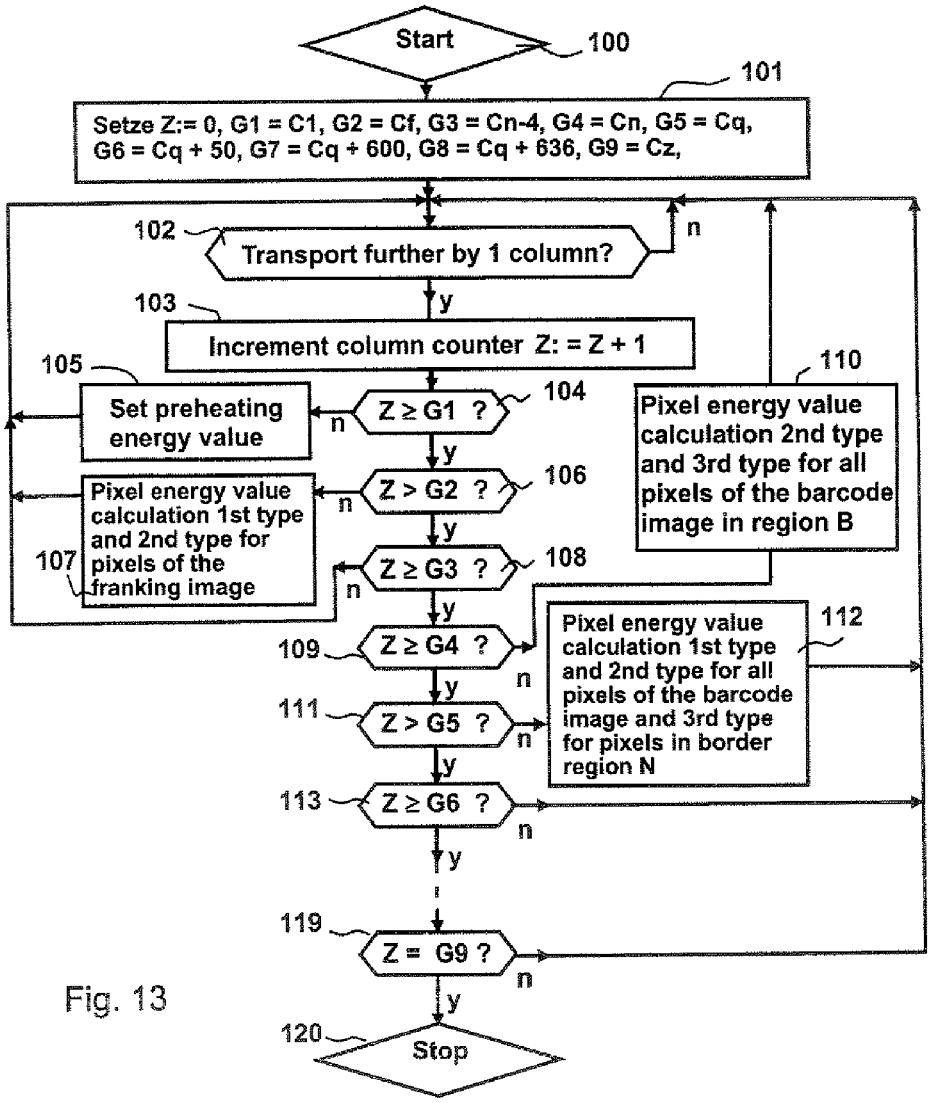
FIG. 13 shows program routine with determination of the energy values for preheating and border heating of a thermotransfer print head.

A program routine with determination of the energy values for preheating/border heating of a thermotransfer print head is shown in FIG. 13. This program routine contributes to the quality improvement in the thermotransfer printing method and thus contributes to the better machine readability of barcode as well. After the start in step 100 the column counter of the microprocessor is set to the counter state Z:=0 in a step 101. Moreover, limit values of the print column count are predetermined which define the length of the print stamp image to be printed. A first query step 102 is then reached. The further transport of the franking label simultaneously ensues. The heating elements of the thermotransfer print head respectively stand at the end of a preheating phase over the next virtual print column. When it is established in a first query step 102 that the label was transported further by one column, the column is incremented by the value "one" in a step 103. Otherwise, when it is established in a first query step 102 that the strip was transported further by one column, the column counter is then incremented by the value "one" in a step 103.

A second query step 104 is subsequently reached in which it is queried whether the count value is already greater than/equal to the first limit value G1=C1, whereby the printing begins with the print column C1. If this is not the case, the program routine branches back to the first query step 102 via a step 105. Further phases which serve only for preheating of the thermotransfer print head and thus are not visible as print columns thus precede the print column C1. The columns situated before this are therefore designated as virtual print columns. In each such virtual print column the heating elements of the thermotransfer print head are activated with a pulse whose pulse duration is not sufficient for printing. After this the column counter is incremented by the value "one" in a step 103. This continues until the print column C1 is reached.

However, if in a second step 104 it is established that the count value is already greater than/equal to the first limit value Z≧G1, the program routine is branched to a third query step 106 in which it is established whether the count value is already greater than the second limit value, i.e. Z≧G2. G2 is equal to Cf, and Cf is that column with which the printing of the franking stamp image ends. If this is not the case, via a step 107 the program routine branches back to the first query step 102. In a step 107, the pixel energy value calculation ensues according to a first type that ensues dependent on predetermined parameters and was already described above. In step 107 the pixel energy value calculation likewise ensues according to a known second type corresponding to the prior history of the activation of the heating elements and their adjacent heating elements via the microprocessor. Given each pass through the step 103 the column counter is increased by the value "one". The query step 106 is passed through, whereby the response is YES. The response in the third query step 109 is NO, however only until the end of the franking stamp image is reached with the print column with which a limit value G2 can be associated.

If in a third query step 106 it is established that the count value is already greater than the second limit value, thus Z>G2, the program routine branches to a fourth query step 108 in which it is established whether the count value is already greater than/equal to the third limit value, thus Z≧G3. If this is not the case, the program routine branches back to the first query step 102. In a step 103 the column counter is increased again by the value "one" and the query steps 104 and 106 are run through, whereby the answer is YES. This continues until a print column Cn−4 is reached with which a limit value G3 can be associated.

If in a fourth query step 108 it is thus established that the count value is already greater than/equal to the third limit value, thus Z≧G3, the program routine then branches to a fifth query step 109 in which it is established whether the count value is already greater than/equal to the fourth limit value (thus Z≧G4) which can be associated with a first print column at the start of the barcode image. If this is not the case, the program routine then branches back to the first query step 102 via a step 110.

In a step 110 the pixel energy value calculation likewise ensues according to a known second type corresponding to the prior history of the activation of the heating elements and their adjacent heating elements via the microprocessor. Before the printing of a dot of the barcode image, a predetermined first energy value EH can be supplied to the respective heating element which is used in the region B. The energy value $E_H$, however, does not lead to the printing but rather effects only a predetermined preheating of the corresponding heating element in at least one of the preceding phases (history control method).

Moreover, the pixel energy value calculation of a third type ensues for all pixels before the barcode image in the region B. For example, before the printing of the barcode image a predetermined second energy value $E_V$ should also be supplied to each heating element in the first four print columns which is associated with the region B, however was not used because no dot should be subsequently printed immediately. With each phase of the heating of a heating element the present base energy or the energy supplied previously in the phases is increased by one energy level. Before the printing of the barcode image 15, the predetermined second energy value $E_V$ is supplied to each of the heating elements in the region B which are not used for a predetermined preheating with the first energy value $E_H$.

The second energy value $E_V$ lies at least one energy level (advantageously two energy levels) below that first energy value $E_H$ that should be supplied for heating of the respective heating elements which should be used in region B according to the history control method. The heating elements that are also not subsequently used in printing or are not subsequently immediately used in printing are thus likewise heated, in contrast to the history control method.

After the first query step 102, the step 103 is run through again and the column counter is increased by the value "one". The query steps 104, 106 and 108 are executed, for which the responses are respectively YES. The response in the fifth query step 109 is NO, but only until a fourth limit value G4 with a print column Cn at the start of the barcode image is not yet reached. However, then this is reached the program routine is branched to a sixth query step 111. In the sixth query step 111 it is asked whether the count value is already greater than the fifth limit value (thus Z>G5), whereby the printing ends with the print column Cq. If this is not the case, the program routine branches back to the first query step 102 via a step 112. A pixel energy value calculation of the first type and of the second type for all pixels of the barcode image and a pixel energy value calculation of the third type for pixels in the border region N of the barcode image is [sic] implemented by the microprocessor in a step 112 beginning with the print column Cn and ending with the print column Cq, i.e. from the start to the end of the barcode image. A border region exists when the length of the barcode image is smaller than the length of the row of heating elements (strip width). Energy values for the heating of the heating elements at the edge of the heating element row are calculated by the microprocessor, which energy values are associated with the pixels in at least one of the two border regions N external to the barcode image, whereby the energy values of such a level are calculated such that as a result no dots are printed by the corresponding heating elements at the edge of the heating element row. It is provided that the calculation exists in an addition of a previous experimentally-determined energy value $E_N \leqq 2/10\ E_{max}$. Alternatively, the substrate temperature of the thermotransfer print head 1 can be measured and a threshold comparison is implemented, whereby given a threshold under-run of the substrate temperature an energy value $E_N$ that is higher by one level is selected by the microprocessor After the first query step 102 the step 103 is executed again and the column counter is increased by the value "one". The query steps 104, 106, 108 and 109 are executed, for which the responses are respectively YES. The response in the sixth query step 111 is NO, however only until a fifth limit value G5 is not yet exceeded with the print column Cq at the end of the barcode image. However, when this is exceeded the program routine branches to a seventh query step 113. This continues until a sixth limit value G6 with a print column CQ+50 is reached at the start of the barcode image. As long as this is not the case, the program routine branches back to the first query step 102. When this is the case the program routine branches to further query steps (which are not shown) in order to calculate energy values for the remaining print stamp images until a penultimate query step 119 is reached in which it is asked whether the last print column Cz is reached at the end of a franking imprint, When this is not the case, the program routine branches back to the first query step 102. When this is the case the routine is stopped in a step 120.

The routine can be adapted for the postal regulations applicable in other countries, correspondingly modified for the required franking imprints or, respectively, be reasonably used for other print images of similarly printing accounting or mail processing apparatuses.

Figure 14A:
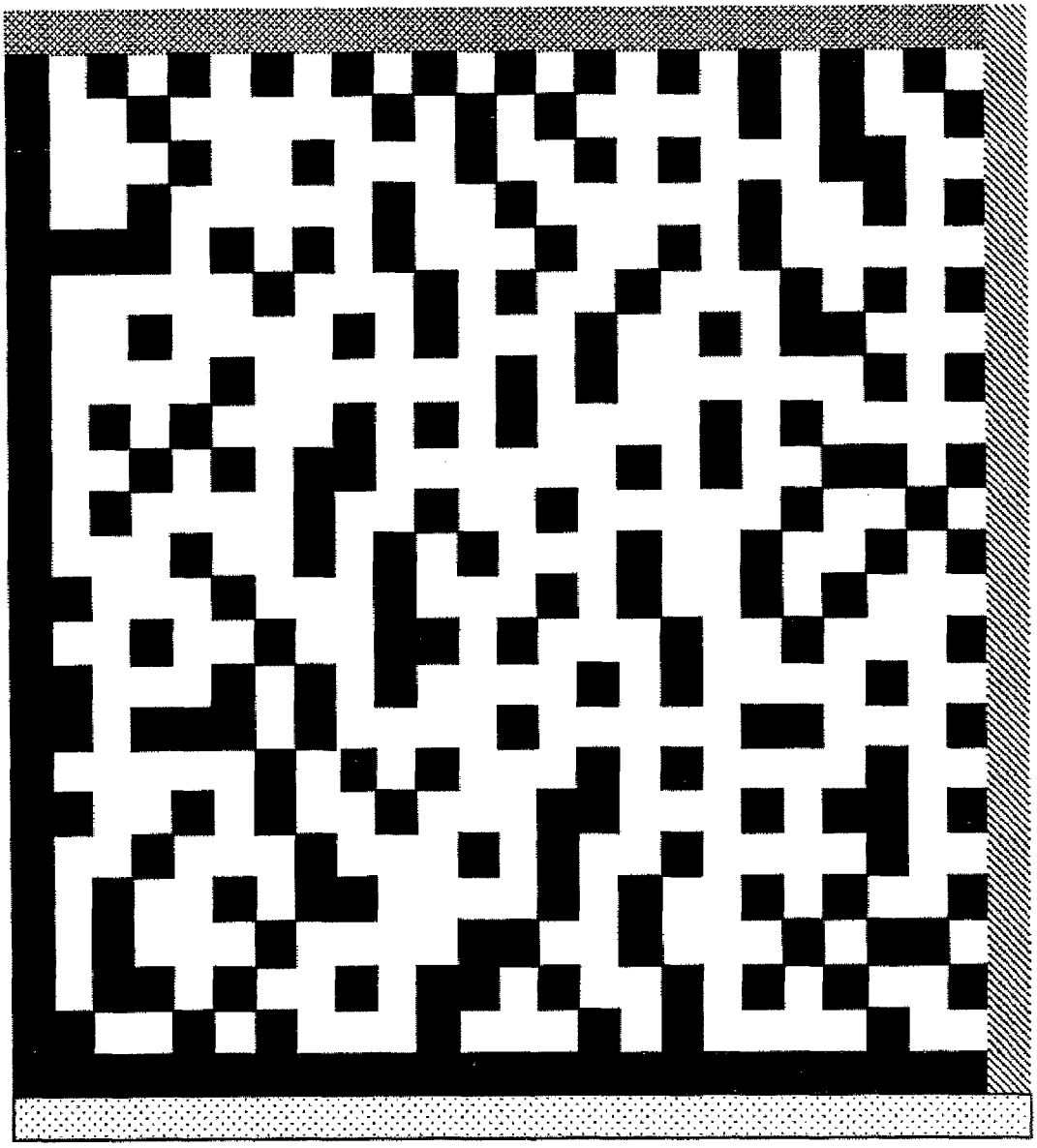
FIG. 14*a* shows barcode image with external regions for explanation of data preparation that is different for these regions, the external regions serving for the pre-heating of heating elements (variant 2).

A barcode image with external regions for clarification of a data preparation that is different for these regions, which external regions serve for preheating of heating elements, is shown in FIG. 14*a* for a second variant. For printing with a stationary print head of a two-dimensional barcode on the surface of the mail piece, a mail piece is moved from a feed position upstream (in terms of mail flow) of a printing location in a direction pointing downstream (in terms of mail flow). When the feed position upstream (in terms of mail flow) of the print location is located to the left of the franking machine (FIG. 11), an adjacent leading region B then exists to the right of the printed barcode, which adjacent leading region B, during the feed of the mail piece to the printing location, is reached earlier than the region which is provided for the printing of the two-dimensional barcode. The adjacent leading region B external to the barcode image is drawn hatched from the upper left to the lower right and is subsequently designated more precisely as a region B that is not be printed and which serves for preheating of heating elements.

All heating elements of a thermotransfer print head that lie in a row, these heating elements acting on the surface of the mail piece and being arranged orthogonally to the printing direction, and are thus preheated chronologically before the printing of the dots in a first pc of the two-dimensional barcode imprint. The aforementioned heating elements are activated with a preheating pulse which at most reaches 20% of the maximum pulse length of a printing pulse, such that although the heating elements become warm they do not yet cause printing. That leads to a predetermined advantageous temperature distribution in the print head and as a result to a uniform printing.

The heating elements and surrounding heat capacitors are moreover preheated in a region N1 that is not to be printed, which region N1 is placed over the 50% line of the upper part of the barcode image in the representation. This boundary region N1 external to the barcode image is characterized with a diamond pattern and is subsequently designated more precisely as a region N1 that is not be printed and which serves for heating of heating elements during the printing of the barcode.

During the printing of the barcode a heating element of the adjacent row directly above the barcode image is activated with a pulse length of 0.2=20% of the maximum print pulse length for a predetermined number of print columns, such that the heating element is warm but cannot yet print. The surroundings of the heating elements that are used for printing of the 50% line are thus heated such that this is mapped just as well as the barcode elements (modules) within the barcode.

In FIG. 14*a* the quadratic modules without pre-heating are shown black inside the two-dimensional barcode. No energy values of a second type are set, at least in that memory space in the pixel energy memory that precedes the position of a dot to be printed in the barcode image when the pixel energy value calculation of the first type suffices for a printing of readable modules within the two-dimensional barcode (for low requirements of readability) or when a different suitable method for energy value calculation is used for higher readability requirements of the modules, which replaces the aforementioned pixel energy value calculation of the first type and second type for the modules.

No preheating of heating elements is required in the region N2 (drawn dotted) under the barcode image when the heating elements are not associated with any region to be printed.

In barcode printers of other types it can be reasonable to differentiate the heating elements to be heated in positions at the boundary regions (top, right, bottom and left) of the barcode imprint, so that they are heated differently. In contrast to this, in the aforementioned second variant of the data preparation for preheating of heating elements, those of the heating element rows that are associated with the left region of the barcode imprint upon transport of the mail piece are, for example, not heated at all since no dots are printed in the image columns immediately after them and the print head has also already reached its operating temperature. Those heating elements in the boundary region of the heating element row that lie opposite the lower region of the barcode imprint upon transport of the mail piece must likewise not be heated when the print head has already reached its operating temperature due to a printing of a 100% line with the immediately-adjacent heating elements.

Figure 14B:
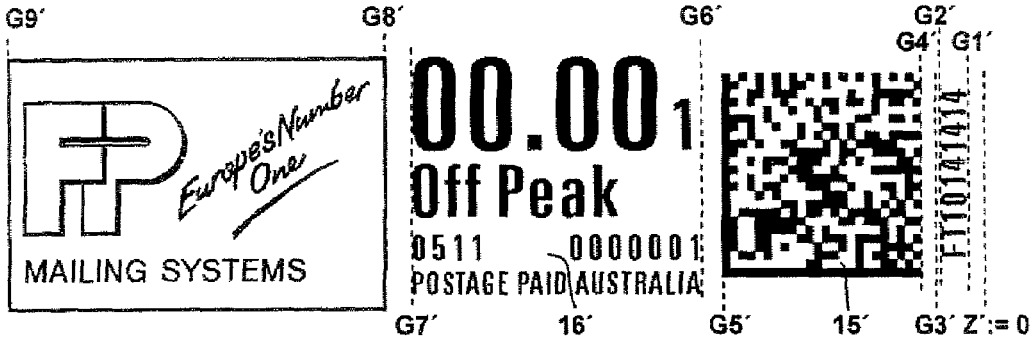
FIG. 14*b* shows a franking imprint according to the postal requirements for Australia.

A franking imprint corresponding to the postal requirements for Australia is shown in FIG. 14*b*. Here the barcode 15' is arranged to the right of the value stamp and (in contrast to the printing of the barcode 15 according to the program routine shown in FIG. 13) is thus printed chronologically earlier than the value stamp 16'.

Figure 14C:
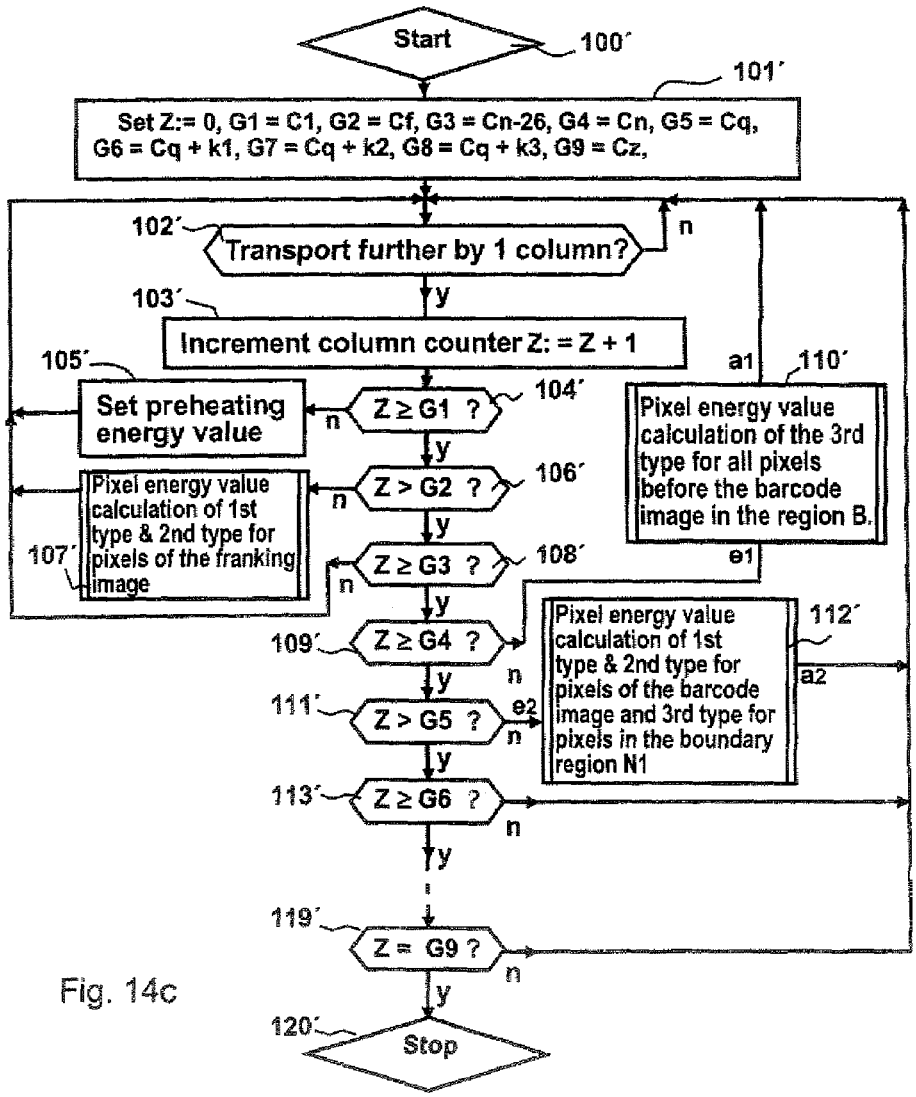
FIG. 14*c* is a program routine with determination of the energy values according to a further variant for preheating and boundary heating of a thermotransfer print head (variants 2 and 3).

A program routine with determination of the energy values according to a further variant for preheating and boundary heating of a thermotransfer print head is shown in FIG. 14*c*. Relative to the workflow of the steps 100 through 120 in the program routine according to FIG. 13, the value of the limit values G1 through G9 for the column counter change in a step 101' (equivalent to the step 101) and the subroutine is changed in a step 110' (equivalent to the step 110). In the step 110' it is provided that a predetermined energy value $E_H$ is supplied to all heating elements of a heating element row which are used in a leading region B before the printing of the barcode image 14. A first energy value $E_H$ corresponds to a heating pulse length that, however, does not lead to the printing but rather only effects a predetermined preheating of the corresponding heating element in at least one of the preceding phases, whereby an energy of up to two tenths of the maximum energy value is supplied to all heating elements in the leading region B and, in the boundary region N1, at least one heating element that is not to be printed at the edge of the heating element row of the thermotransfer print head 1. The known pixel energy value calculation of the second type is thus omitted in the step 110' and in step 110' and 112' a second variant is selected for the pixel energy value calculation of the third type. In the third variant, in a time range before the printing of the barcode image 14, an energy of one tenth of the maximum energy value is-supplied (via a heating pulse during the time duration which has the duration of one phase of a print pulse) for preheating of each non-printing heating element when an image column of the leading region B that is situated at a distance from the edge of the barcode image 15 reaches the print location, whereby the phased alternates with a different phase in which no energy is supplied to the non-printing heating element. Furthermore, the distance from the edge of the barcode image 15 amounts to at least two image columns when an energy of one tenth of the maximum energy value is supplied to the heating element for preheating by a heating pulse during a time duration of the duration of one phase of a printing pulse.

This is subsequently explained in detail using pulse/time diagrams for a preheated heating element past which the regions B and N1 are moved when the mail piece is transported further during the printing.

Figure 15A:
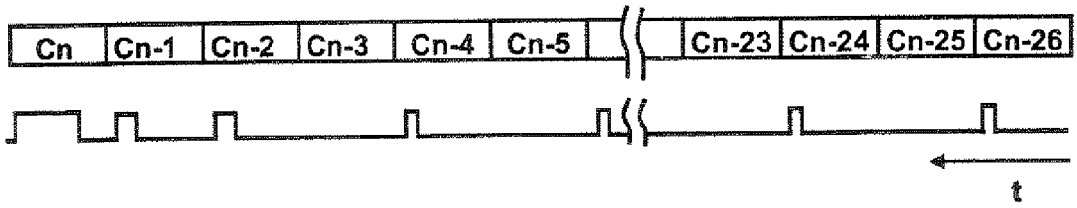
FIG. 15*a* is a pulse/time diagram for activation of a heating element of the thermotransfer print head, which heating element is activated in the leading region B.

FIG. 15*a* shows a pulse/time diagram for activation of a heating element of the thermotransfer print head according to the third variant, which heating element is activated in a leading region B. In a first row the print column Cn and image columns Cn−1 through Cn−26 are respectively spaced such that an interval respectively corresponds to the time duration of print pulse duration plus a pulse pause. A pulse/time diagram is shown in a second row. The print column Cn is that in which at least one heating element of the thermotransfer print head prints a dot for a pixel of the barcode on the mail piece surface. A number of for example 12, of directly successive print columns Cn, Cn+1, Cn+2, . . . , Cn+11 and twelve adjacent heating elements are required in the heating element row of the thermotransfer print head in order to print a module designated quadratic image element [sic] of the barcode according to FIG. 14*a*. these heating elements are already heated in advance (for example in the image column Cn+26, i.e. when the print location is still 26 image columns away) with a first pulse of the energy E=1/10 Emax. That is reached by heating pulses of the duration of 0.1=10% of the maximum print pulse length. When a print pulse can be temporally subdivided into phases of equal duration (for example 0.1 [sic]), the existing base energy can be increased by one level with each phase of the heating of a heating element.

According to the example, a time duration of 26 clock pulses then elapses until the printing of the dots. One clock pulse results from a print pulse duration plus an associated pulse pause. A heating pulse is emitted when the image column Cn−25 reaches the print location; however, a heating pulse of the energy E=1/10 Emax is emitted again when the image column Cn−24 reaches the print location. The heating pulse emission alternates with the non-emission until, for example, the image column Cn−2 is reached in which a heating pulse of the energy E=2/10 Emax is emitted to the heating elements which should print the barcode. When the subsequent image column Cn−1 is reached, a heating pulse of the energy E=2/10 Emax is emitted again. Alternatively, a heating pulse of the energy E=3/10 Emax would also be possible. This variable energy feed is enabled via an electronically-controlled variation of the pulse duration. For this a subroutine is used that is explained in further detail using FIG. 16.

By the omission of the pulses in the image columns Cn−3 through Cn−26, a representation (not shown) of a pulse/time diagram for activation of a heating element activated in the leading region B also results for the second variant of the quality improvement.

Figure 15B:
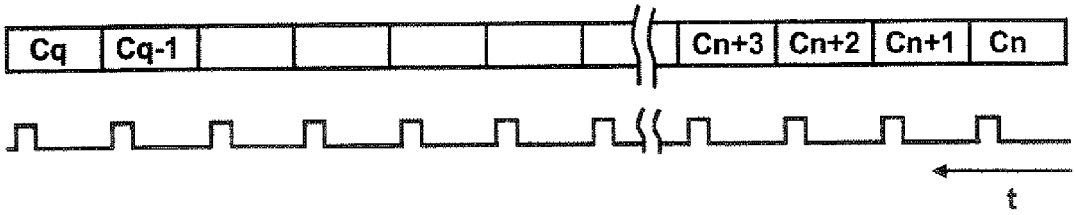
FIG. 15*b* is a pulse/time diagram for activation of a heating element of the thermotransfer print head, which heating element is situated in the boundary region N1.

FIG. 15*b* shows a pulse/time diagram for activation of a heating element of the thermotransfer print head that is placed in the boundary region N1. In the immediately following print columns Cn, Cn+1, Cn+2, . . . , Cn+11, . . . , the adjacent heating element in the heating element row of the thermotransfer print head is fed with a heating pulse of the energy E=2/10 Emax that is not sufficient for printing of a dot. For this a subprogram routine is used which is explained further using FIG. 17. The representations according to FIGS. 15*b* and 17 similarly apply for the second and third variants of the quality improvement.

Figure 16:
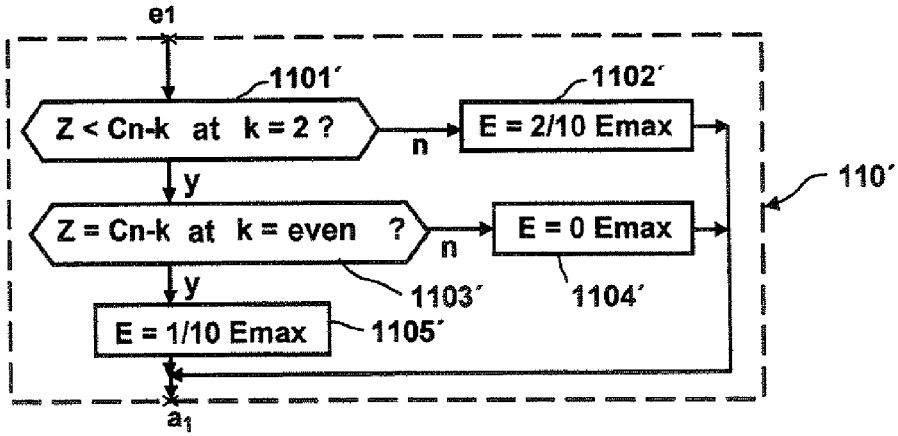
FIG. 16 is a sub-routine with determination of the energy values according to the third variant for preheating of a thermotransfer print head.

FIG. 16 shows a subprogram routine 110' with determination of the energy values according to the third variant for preheating of a thermotransfer print head. The counter state Z of the column counter is queried in a first step 1101'. If the counter state Z is smaller than the limit value Cn−k (which is initially the case), the routine branches to a third step 1103' and the counter state Z of the column counter is evaluated as to whether the value Z=Cn−k exhibits a k-value whose value is even or odd. Given an even k-value the pulse energy is set at E=1/10 Emax. Otherwise, given an odd k-value the pulse energy is set at E=0 Emax. If the counter state Z is not smaller than the limit value Cn−k, the routine branches to a second step 1102' and the pulse energy is set at E=2/10 Emax. The representation according to FIG. 16 applies only for the third variant of the quality improvement.

A representation (not shown) of a subprogram routine also results for the second variant of the quality improvement when the steps 1103' through 1105' are omitted.

Figure 17:
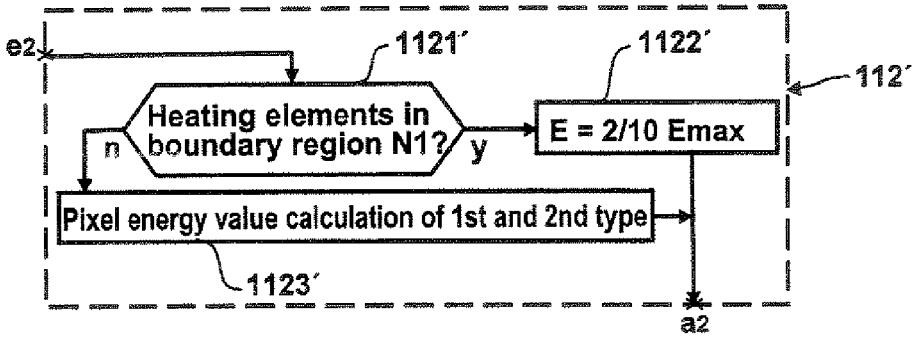
FIG. 17 is a sub-routine with determination of the energy values according to the second and third variants for preheating of a thermotransfer print head and for pixel energy value calculation.

FIG. 17 shows a sub-routine with determination of the energy values according to the second or, respectively, third variants for boundary heating of a thermotransfer print head and for pixel energy value calculation 1123' of the latter ensues when heating elements in the boundary region N1 other than those queried in step 1121' are activated Otherwise the pulse energy is set to E=2/10 Emax in a step 1122'.

Figure 18:
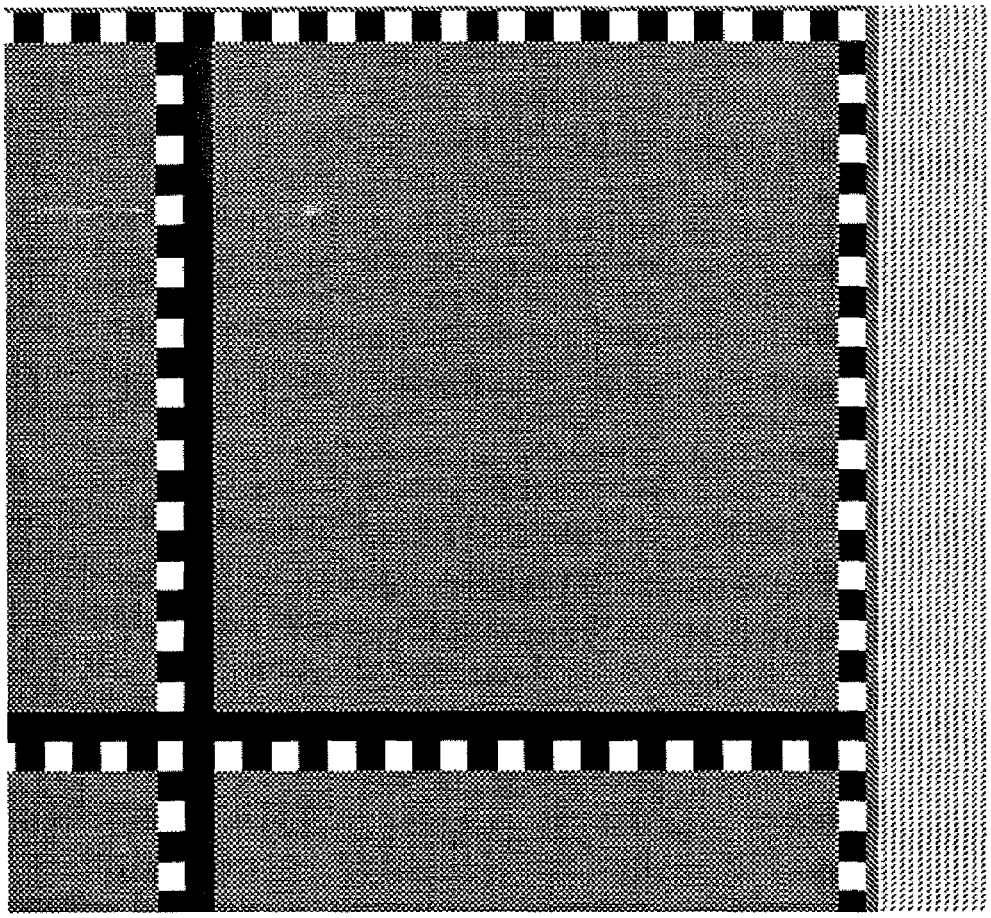
FIG. 18 shows a barcode image with external regions for explanation of a data preparation that is different for these regions, the external regions serving for the pre-heating of heating elements (variant 3).

In FIG. 18 a barcode image with external regions is shown for clarification of a data preparation for preheating of heating elements according to the third variant, which data preparation is different for these regions, This third variant was developed by Francotyp Postalia GmbH under consideration of the postal regulations for the country Canada. The data content of the barcode is not essential for understanding of the preheating. For simplicity the modules are only shown at the edge of the barcode image and shows as components of the 50% or 100% lines, respectively.

The activation methods for the thermotransfer print head take into account a different boundary heating for the data matrix barcode. This leads to the increase of the read rate for the data matrix barcode printed in the thermotransfer printing method. Near the 50% line at the upper and right boundary external to the data matrix barcode, the detail view of the upper right barcode corner of the data matrix barcode shows a preheating with a heating pulse of 20% of the maximum print pulse duration, and moreover a preheating with a heating pulse of 10% of the maximum print pulse duration, which preheating entirely precedes the printing of the data matrix barcode at an interval. The aforementioned interval from the boundary of the barcode image amounts to at least two image columns. The following method is advantageously proposed:

The heating elements and surrounding heat capacitors are preheated in non-printing region B that is placed to the right of the barcode in the representation. In the imprint, invisible print columns Cn−y through Cn−1 thus can be defined that are directed along under the heating element row of the print head chronologically prior to the printing of the data matrix barcode, so all heating elements are activated with a heating pulse of the pulse length of 10% of the maximum print pulse length in the image column Cn−y (which arrives in a position under the heating element row earlier than a subsequent image column Cn−(y−1)) while none of the heating elements is heated with a heating pulse in the subsequent image column Cn(y−1). Following this, for example twelve times in alternation, are a per-column heating of the heating elements of the heating element row that can be currently associated with an image column (which heating ensues with the pulse length of 0.1 of the maximum print pulse length), and a per-column non-heating of the heating element row that can be associated with the subsequent adjacent image column. In a column Cn−4 shows in FIG. 1, all heating elements are thus heated with a heating pulse of the pulse length of 0.1 of the maximum pulse length In a column Cn−3 adjacent to that shown in FIG. 1, none of the heating elements are heated with a heating pulse. However, in the adjacent columns Cn−2 and Cn−1 all heating elements are heated with a heating pulse of the pulse length of 0.2 of the maximum print pulse length.

Figure 19:
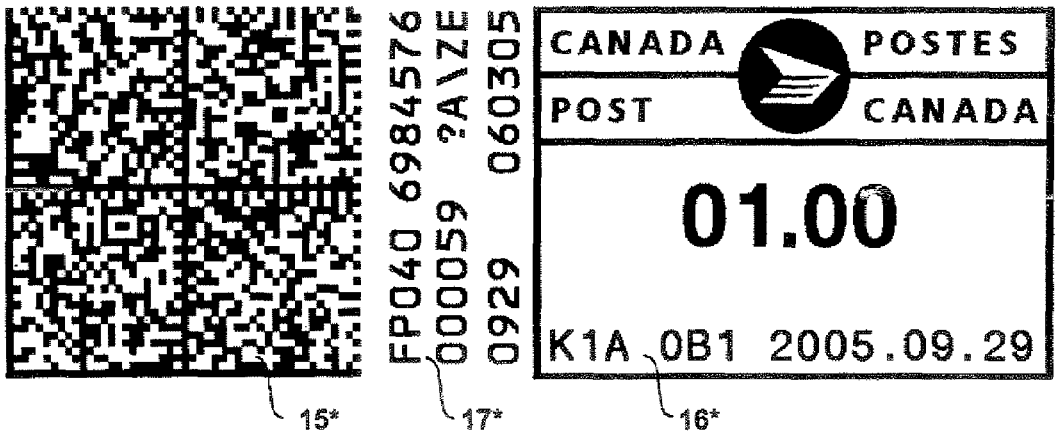
FIG. 19 shows a franking imprint according to the postal requirement for Canada.

FIG. 19 shows a franking imprint according to the postal requirements in Canada. The barcode 15* is arranged to the left of the value stamp 16* and—in contrast to the barcode 15 shown in FIG. 12—is printed at an interval from the value stamp 16*. Within the interval a stamp image 17* is printed with further data dictated by the postal authority. A program routine (modified with regard to the program routine shown in FIG. 13) for determination of the energy values for a printing of the barcode image in better quality thus also exists, whereby the invention emanates from the same basic ideas.

The variants 2 or 3 or a different variant (not described in detail) for quality improvement can be used for the generation of an image according to FIG. 19, but the latter different variant essentially is based on the same inventive concept.

Although mail pieces, letter envelopes and franking labels are discussed in the aforementioned example, other forms of print goods should are not excluded. Any print items that can be printed by printing devices according to the thermotransfer printing method are included.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for printing an image with a thermotransfer print head, having a row of heating elements. of a printing device having a controller equipped with a microprocessor and a pixel energy memory for data processing before printing and to initiate and to control a printing process, said method comprising calculating a first energy quantity at least with inclusion of machine parameters in a first determination step before printing, and in a first feed step supplying the first quantity to a first heating element of the thermotransfer print head to transfer ink from an ink ribbon associated with the thermotransfer print head onto a print medium surface, and calculating an energy value according to a first type, after which data of the print image are processed by the microprocessor in order to also activate heating elements in at least one of two border regions of a heating element row where no dots should be printed during the printing of the image; and additionally activating heating elements that do not lie in the two border regions of the heating element row for a limited time duration, said time duration immediately preceding printing of the image, and buffering energy values for each of the heating elements of the thermotransfer print head in a non-volatile manner in the pixel energy memory.

2. A method according to claim 1, comprising employing a different data preparation by the microprocessor for regions external to said image.

3. A method according to claim 1 comprising after the calculation of the first and second energy values, transferring data for respective pixel energy values via a bus into a print data controller and said print data controller in converting the data into a corresponding amount of binary pixel data with the same binary value, and in outputting each binary pixel data value to be supplied to a heating element to respective driver units of the thermotransfer print head in an associated phase of temporally successively running phases of a print pulse duration to convert the print data into print pulses of predetermined voltage level and with a duration that is separately adjustable for the heating elements.

4. A method according to the claim 3, comprising applying a voltage as said print pulse to the heating elements, and dividing the print pulse into phases of equal duration; and increasing base energy with each phase of the heating of a heating element or the energy supplied previously in the phases by one energy level, and also heating subsequent heating elements that are not used or are not immediately subsequently used for printing.

5. A method according to claim 4, comprising calculating the energy values for heating of the heating elements at an edge of the heating element row by the microprocessor, said energy values being associated with the pixels in at least one of the two border regions external to the image so that no dots are printed out by the heating elements at the border of the heating element row.

6. A method according to claim 5 comprising supplying energy up to two tenths of a maximum energy value to each heating element at the border of the heating element row of the thermotransfer print head while the image is printed.

7. A method according to claim 6 comprising, supplying said first and second energy values in to a predetermined energy value.

8. A method according to claim 6 comprising measuring a substrate temperature of the thermotransfer print head and comprising the measured substrate temperature to a threshold, and if the substrate temperature is below the threshold, increasing said predetermined energy value by one level is selected in the microprocessor.

9. A method according to claim 4 comprising supplying a predetermined first energy value heating elements used in a region external to said image before printing the image; said predetermined first energy value $E_H$ being insufficient to cause printing, but rather only causing a predetermined preheating of the respective heating elements in at least one of the preceding phases, and supplying a predetermined second energy value to each of heating elements in said region external to said image before printing the image that are not supplied with the predetermined first energy value, the predetermined second energy value being at least one energy level below the predetermined first energy value.

10. A method according to claim 4, comprising supplying a predetermined energy value EH to all heating elements of a heating element row which are used in a leading region before printing the image, a said first energy value EH a heating pulse length that, does not cause printing but causes only a predetermined preheating of the heating element in at least one of the preceding phases, and supplying an energy of up to two tenths of a maximum energy value to all heating elements in the leading region and, in the a boundary region, to at least one non-printing heating element at the boundary of the heating element row of the thermotransfer print head.

11. A method according to claim 10 comprising in a time span before printing the image when an image column of the leading region that is situated at a distance from the edge of the barcode image reaches a print location, preheating every non-printing heating element by supplying an energy of one tenth of the maximum energy value with a heating pulse during a time duration which has a duration of one phase of a printing pulse, and alternating the phase with another phase in which no energy is supplied to the non-printing heating element.

12. A method according to claim 11, wherein the distance from the edge of the image amounts to at least two image columns when an energy of one tenth of the maximum energy value is supplied to the heating element for preheating with the heat pulse during said time duration of one phase of a printing pulse.

13. A thermotransfer printing arrangement comprising thermotransfer print head comprising a row of heating elements, said row of the heating elements of the thermotransfer print head having a length that exceeds a length of a row of image elements at a border of an image which is printed last; said thermotransfer print head being arranged in a printing device and connected with a controller equipped with a microprocessor programmed to calculate energy values, before a printing process, for activating said heating elements said microprocessor calculating said energy values for heating elements at ends of the row of heating elements of the print head to activate said heating elements in warming phases when no dot to be printed at borders external to the image; and calculating an energy value to be supplied to the thermotransfer print head in different manners for printing of a dot.

14. An arrangement according to claim 13 wherein said microprocessor implements said energy value calculation according to a first calculation type and a second calculation type and by calculating an energy quantity to be supplied to each heating element of the thermotransfer print head dependent on machine parameters and dependent on different image segments of the image, and by evaluating history-related information and environment information about the activation of each heating element of the thermotransfer print head to modify the calculated energy quantity or for generation of an energy quantity for preheating of a heating element as well as to determine the energy values respectively associated with each heating element of the thermotransfer print head.

15. An arrangement according to claim 13 comprising a print head controller connected to said microprocessor and said print head, and a pixel energy memory that buffers the energy values in a non-volatile manner connected in terms of data and control with the thermotransfer print head via the print data controller.

16. An arrangement according to claim 15 wherein the print data controller is realized a field programmable module.

17. An arrangement according to claim 15 wherein the print data controller is realized an application specific integrated circuit.

18. An arrangement according to claim 14 wherein said print head comprises at least one heating element at a boundary of the heating element row, said at least one heating element being supplied with energy of up to two tenths of a maximum energy value as a result of an energy value calculation by said microprocessor according to a third type, said energy value calculation of the third type being implemented empirically or computationally by the microprocessor, and wherein said at least one heating element is immediately adjacent thereto which is used for printing of a 50% line at an upper boundary of the image.

* * * * *